United States Patent [19]

Gordon

[11] Patent Number: 4,819,937

[45] Date of Patent: Apr. 11, 1989

[54] COMBINED BATTING TEE AND STRIKE INDICATOR

[76] Inventor: James Gordon, 350 Sorrento Ranches Dr., Nokomis, Fla. 34275

[21] Appl. No.: 217,944

[22] Filed: Jul. 12, 1988

[51] Int. Cl.[4] ..... A63B 69/40

[52] U.S. Cl. ..... 273/26 R; 273/26 A

[58] Field of Search ..... 273/26 R, 29 A, 33, 273/202

[56] References Cited

U.S. PATENT DOCUMENTS

| | | | |
|---|---|---|---|
| 2,978,246 | 4/1961 | van Groningen | 273/26 |
| 3,139,282 | 6/1964 | Lande | 273/26 |
| 3,489,411 | 1/1970 | Morelli et al. | 273/26 |
| 3,583,703 | 6/1971 | Brown et al. | 273/26 |
| 3,633,909 | 1/1972 | Doynow | 273/26 |
| 3,658,329 | 4/1972 | Ciccarello | 273/26 |
| 3,883,138 | 5/1975 | Chorey | 273/26 R |
| 3,967,822 | 7/1976 | Candor et al. | 273/26 R |
| 4,210,326 | 7/1980 | Booth et al. | 273/26 A |
| 4,227,691 | 10/1980 | Lefebvre et al. | 273/26 R |
| 4,254,952 | 3/1981 | Playter | 273/26 |
| 4,295,648 | 10/1981 | Strombeck | 273/26 A |
| 4,383,686 | 3/1983 | Cardieri | 273/26 R |
| 4,445,685 | 5/1984 | Cardieri | 273/26 R |
| 4,456,250 | 6/1984 | Perrone, Jr. | 273/26 R |
| 4,473,227 | 9/1984 | Klaus | 273/26 A |
| 4,664,374 | 5/1987 | Groves | 273/26 R |
| 4,675,250 | 4/1987 | Newland et al. | 273/26 A |
| 4,681,318 | 7/1987 | Lay | 273/26 R |
| 4,709,924 | 12/1987 | Wilson et al. | 273/26 R |

*Primary Examiner*—Richard C. Pinkham
*Assistant Examiner*—T. Brown
*Attorney, Agent, or Firm*—Peter L. Michaelson

[57] ABSTRACT

A portable baseball practice device (10) functioning as either a batting tee or a strike zone indicator is disclosed. As a batting tee, a pair of adjustable stanchions (40 and 50) are mounted on planar, horizontal members (20and 30). One stanchion mounts on an extender member (30) abutting a base plate member (20) which serves as home plate. A cup (46) for resting a ball is at the top of this stanchion. The second stanchion is positioned in the base plate member and adjusted in height relative to the first stanchion so that, for example, a contact-type hitter practices hitting the ball in front of home plate with a slight downswing. As a pitching device, both stanchions are mounted in the extender so that they straddle the base. Indicators such as color bands on the stanchion surfaces provides the high-low range of the strike zone.

18 Claims, 5 Drawing Sheets

COMBINED BATTING TEE AND STRIKE INDICATOR

FIELD OF THE INVENTION

This invention relates generally to a practice device for baseball and, more specifically, to a batting practice tee in one operational mode or, alternatively, a strike zone indicator for a thrown baseball in another operational mode.

BACKGROUND OF THE INVENTION

Each professional season less than 5 per cent of major league baseball players achieve a batting average of 0.300 or better (a "three-hundred hitter"), with the average major leaguer batting only about 0.250. Typically, a three-hundred hitter is a contact-type batter who hits ground balls and line drives and avoids strikeouts, popups, and long fly ball outs. A contact hitter characteristically swings at and connects with the oncoming pitched ball in a slight downward motion when bringing the bat from the "batting stance" position to the "follow-through" position. Also, the contact hitter times his swing to meet the baseball in front of home plate, rather than waiting for the ball to cross the plate. In addition, this type of hitter utilizes full extension of his arms, and shifts his weight during the swing so he is properly balanced to strike the oncoming pitch with maximum effectiveness.

While the hitter is in motion to contact the pitch, it is crucial that the hitter maintains complete concentration and continuous eye contact with the ball. In this way the hitter can react to and swing at the ball as it arrives with varying movement, such as inside-to-outside motion, high-to-low motion, or a combination of these motions brought about by the pitch being, for example, a curve ball, a slider, or a sinker.

In the prior art, U.S. Pat. Nos. 3,967,822; 4,277,691; 4,383,686; 4,445,685; and 4,681,318 disclose single stanchion tube arrangements for holding a stationary baseball and teach hitting the ball over home plate. U.S. Pat. Nos. 3,319,282; 4,664,374; and 4,709,924 disclose basically single tube batting tees (multiple tubes are shown, but only one tee is used per swing), but these patents do depict the possibility of striking the ball in front of the plate. A single tee arrangement does not teach the proper stride and swing to make solid contact with the ball in front of the plate in a relatively planar motion, including the slight downward orientation I espouse. This arrangement precludes the teaching of the desired swing because there is no alignment means to guide the batter with the proper stroke.

U.S. Pat. No. 4,456,250 discloses a multiple stanchion tube arrangement, but it teaches the development of an uppercut swing which is a home-run type swing rather than a contact swing. The multiple tubes are arranged in triangular fashion on a planar base with the frontal tube having a cup for a baseball and the two back tubes having cups for tennis balls or similar lightweight balls. In practicing a swing, the batter first strikes the tennis balls and then the baseball with one swinging motion. The presence of three balls all in different locations creates a distraction and loss of concentration in focusing on the front ball. Most importantly, however, use of the tee teaches the striking of the ball over the plate. This is in contrast to the philosophy of hitting I espouse, namely, that a good contact hitter connects with the ball before it arrives at home plate. In this way, the batter is able to learn to "go with the pitch", i.e. make solid contact with the pitch where it is thrown, so as to hit the pitch hard and down in order to regularly hit line drives and ground balls. This is known to generally result in greater hit production.

In terms of mechanical construction, the prior art tees have numerous small parts, are cumbersome and often require tools to assemble. Also, the adjustable poles can rust or fill with dirt. Some tees have limited adjustment range, that is, the ball can not be placed at desired spots and heights over home plate. In addition, these tees tend to be unstable since the center of gravity is high due to light-weight bases. Finally, these tees are generally costly to manufacture.

Of course, the game of baseball is, in essence, one of challenge—the batter against the pitcher. So, while a batter is training to hit a pitched ball, it is equally important from the pitcher's viewpoint to practice pitching skills.

U.S. Pat. Nos. 3,658,329; 4,295,648; and 4,473,227 are representative of pitching practice devices disclosed in the prior art. These references basically describe and claim single-purpose devices that are characterized as providing frame-type target zones. Each frame is composed of a four-sided, rectangular structure, with the high and low members of the frame representing the top and bottom of the strike zone, whereas the left and right members indicate the inside-outside extent of the strike zone. The frame is adjustable so the strike zone may be contracted or expanded. The prior art devices often: have numerous small parts making assembly difficult or contributing to a fragile structure; have protruding parts that may mar the ball; and are prone to damage from errant pitches striking the frame itself.

Thus, a need exists in the art for a baseball teaching device that can be used as a batting tee for teaching a hitter to develop a slight downward swing and thereby hopefully become a contact-type hitter and also as a pitching device to teach a pitcher to throw for a particular strike zone. Such a device should not have a large number of parts that are cumbersome or require tools to assemble, be susceptible to rusting or filling with dirt, an overly limited adjustment range, be unstable, costly to manufacture, be prone to damage a baseball used with the device or be prone to damage from errantly pitched baseballs that impact the device.

SUMMARY OF THE INVENTION

These shortcomings as well as other deficiencies of conventional batting and pitching practice devices are obviated, in accordance with the present invention, by a versatile, dual-purpose baseball practice device having two operational modes.

In its first operational mode, the practice device serves as a batting tee. In this mode, first and second vertical, adjustable stanchions or poles are mounted on base plate and extender members, respectively. The extender abuts the front edge of the base plate which is representative of home plate. The second stanchion has a support for resting a baseball. Because of the placement of the second stanchion relative to home plate, the batter contacts the baseball in front of home plate when he assumes the normal batter's stance at home plate. The first stanchion is positioned and adjusted relative to the second stanchion to effect the desired swing. For a contact hitter, this is a slight downswing, so that the stanchion is at least as high as the second stanchion. The stanchions can be placed at selected locations on the base plate and extender and adjusted in height so the batter may practice hitting the ball at locations corresponding to, for example, a high inside pitch or a low outside pitch.

In its second operational mode, the practice device functions as a ball-strike pitch indicator. In this mode, the two stanchions are both mounted on the extender in mounting means that straddle home plate. Thus the gap between the stanchions is the same as the width of home plate. Indicators such as color bands appear on the circumference of the stanchions. By adjusting the stanchions, the user may select a high-low range, which in combination with the spacing between stanchions, defines a strike or target zone.

The baseball practice device is advantageously designed with a minimal number of parts and the necessary fasteners are formed integrally with the associated members, thereby eliminating the need for assembly tools. Moreover, this integration allows the user to quickly disassemble and reassemble the unit to facilitate repositioning the location of the baseball relative to home plate. In addition, the device is designed to be completely hazard-free in that no jagged metal parts or protruding nuts and bolts are present. Also, the device is portable so that it may be used at a ball park and, when typically augmented with a net, in one's back yard.

BRIEF DESCRIPTION OF THE DRAWING

The organization and structure of this invention will be better understood by considering the detailed description of the illustrative embodiments thereof, which follows, in conjunction with the drawing, in which.

To facilitate understanding, identical reference numerals have been used to designate identical elements that are common to the figures.

DETAILED DESCRIPTION

Figure 1:
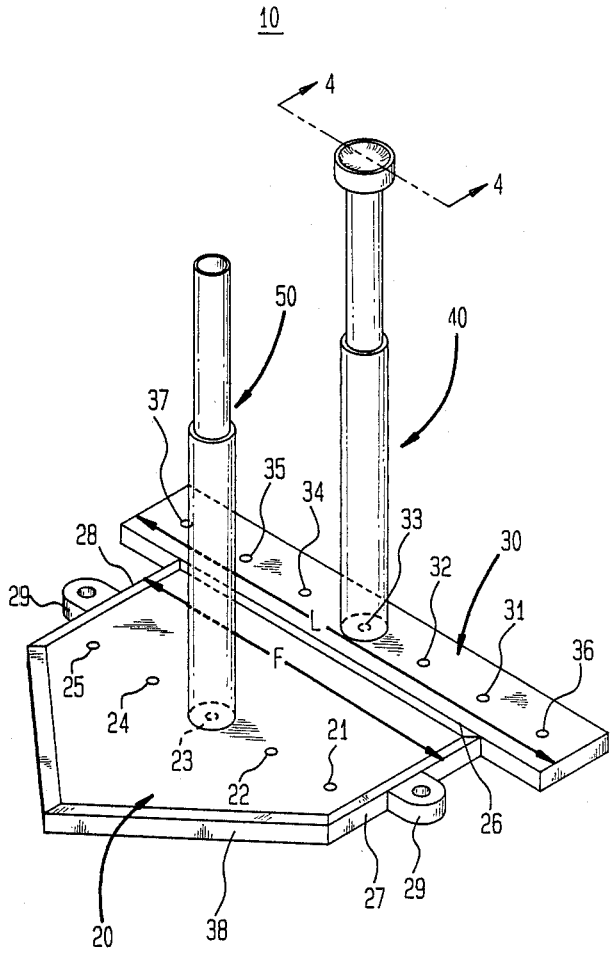
FIG. 1 is a perspective view of assembled practice device 10 shown completely assembled and arranged as a batting tee.
Figure 5:
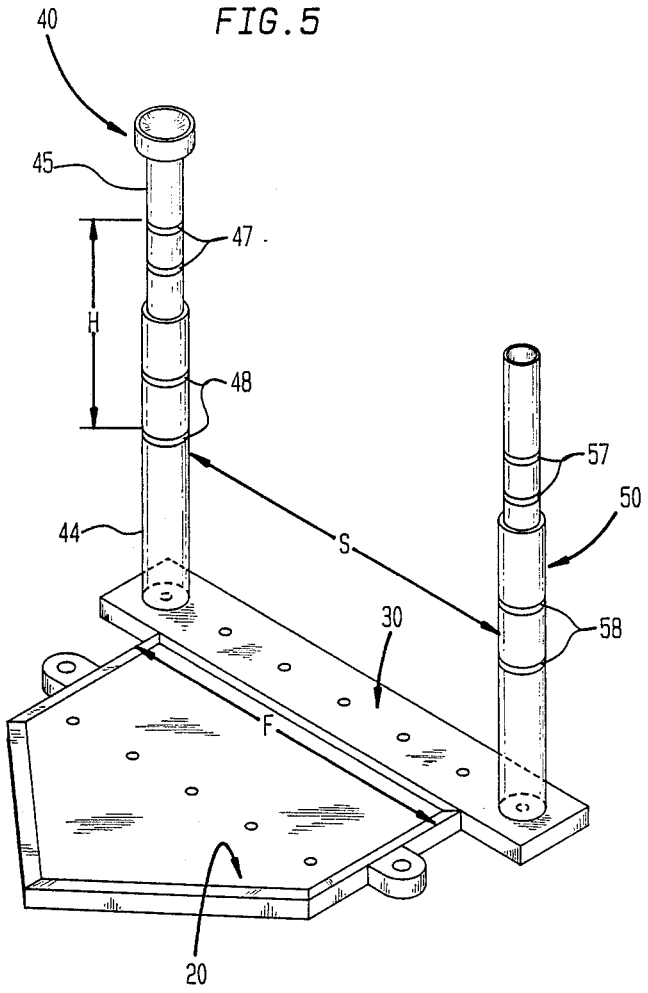
FIG. 5 is a perspective view of assembled device 10 as it is arranged as a pitching practice device.

With reference to FIG. 1, a perspective view of an illustrative embodiment of inventive baseball practice device 10 in accordance with its batting practice mode is depicted. Device 10 includes: a base plate member 20, preferably having the shape and size of a standard home plate (17 by 17 inches or 6.69 by 6.69 cm); and narrow, rectangular extender member 30 abutting frontal edge 26 of base plate 20. Base plate 20 preferably has a row of five apertures 21, 22, . . . , 25 evenly distributed over the centerline portion of the base, with the row substantially parallel to frontal edge 26. Extender 30 is preferably 2 by 19 inches (0.79 by 7.48 cm) and has a row of seven apertures 31, 32, . . . , 37 evenly distributed over the midline of the rectangular shape, with the extender row substantially parallel to the row of apertures in base plate 20. Apertures 31–35 of extender 30 are aligned in front-to-back relationship with corresponding apertures 21–25 in base plate 20. Also, since the longer rectangular dimension of extender 30 (shown as L) exceeds the length of frontal edge 26 (shown as F), apertures 36 and 37 lie outside left and right base plate edges 27 and 28, respectively, and, in effect, straddle base plate 20. Apertures 36 and 37 are utilized primarily when device 10 operates as a pitching practice device, as discussed later (FIG. 5). In addition, a pair of nodules 29 with center holes extend from base plate edges 27 and 28 at about their midpoint; the nodules are optional but are shown for completeness. They are used with anchor means (not shown) such as stakes to provide stability to device 10 when it is employed on a penetrable surface.

Stanchion or pole means 40 and 50 are also shown mounted in one of the apertures of extender 30 and base plate 20, respectively. These stanchions are mounted with a substantially vertical orientation relative to base plate 20 and extender 30. With this arrangement, extender 30 and associated stanchion 40 are in front of home plate, thereby allowing a batter to position himself normally at home plate and hit a baseball placed on top of stanchion 40 in front of home plate. Although with the prior art devices a batter could, in effect, hit the ball in front of the plate by moving back in an imaginary batter's box relative to home plate, this does not teach a consistent and uniform addressing of home plate with a fixed stance; the batter has merely compensated by adjusting his stance. This is in contrast to the teachings of my invention wherein the batter is able to practice his desired stance yet still contact the ball in front of home plate. In addition, the placement and height of stanchion 50 relative to stanchion 40 ensures that the batter swings with a downswing motion desired of a contact hitter. The configuration of poles 40 and 50 is discussed in greater detail shortly.

Figure 2:
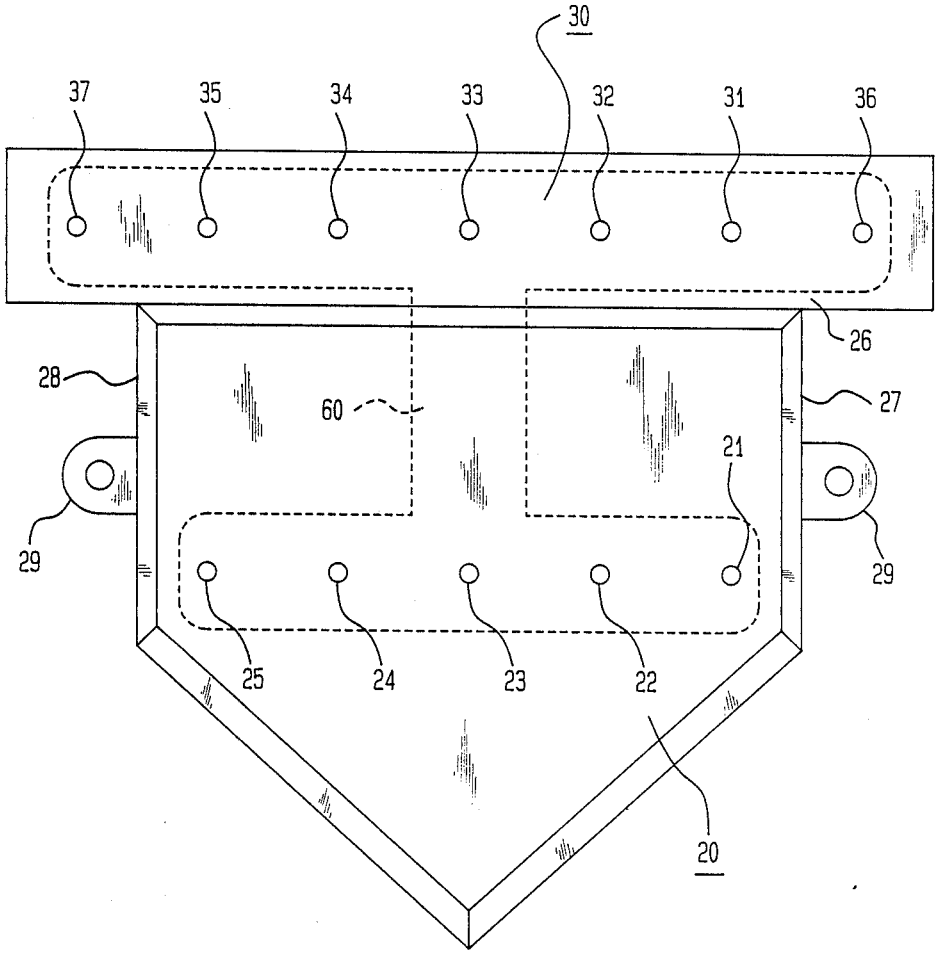
FIG. 2 is a top view of base plate 20 and extender member 30 shown in FIG. 1.

Referring now to FIG. 2, a top view of base plate member 20 and extender member 30 is illustrated. H-shaped member 60 is shown as dashed in FIG. 2. Member 60 depicts one illustrative arrangement for cooperatively forming base plate 20 and extender 30 from a unitary workpiece. Member 60 is preferably constructed of heavy metal. In this embodiment, a single rubber or vinyl cover, having the pentagonal home plate shape of base plate 20 combined with the rectangular shape of extender 30 and the circular shape of nodules 29, is formed with a countersunk H-shape on its underside to receive and register member 60. The H-shape efficaciously provides stability to device 10 whenever it is not convenient to anchor the device with nodules 29. Other shapes may be easily contemplated by those with skill in the art. In addition, base plate 20 can be manufactured using well-known rotation molding techniques which will impart sufficient weight to the base plate and thereby obviate the need to use steel for base member 60. In this instance, base member 60 may be omitted.

Figure 3:
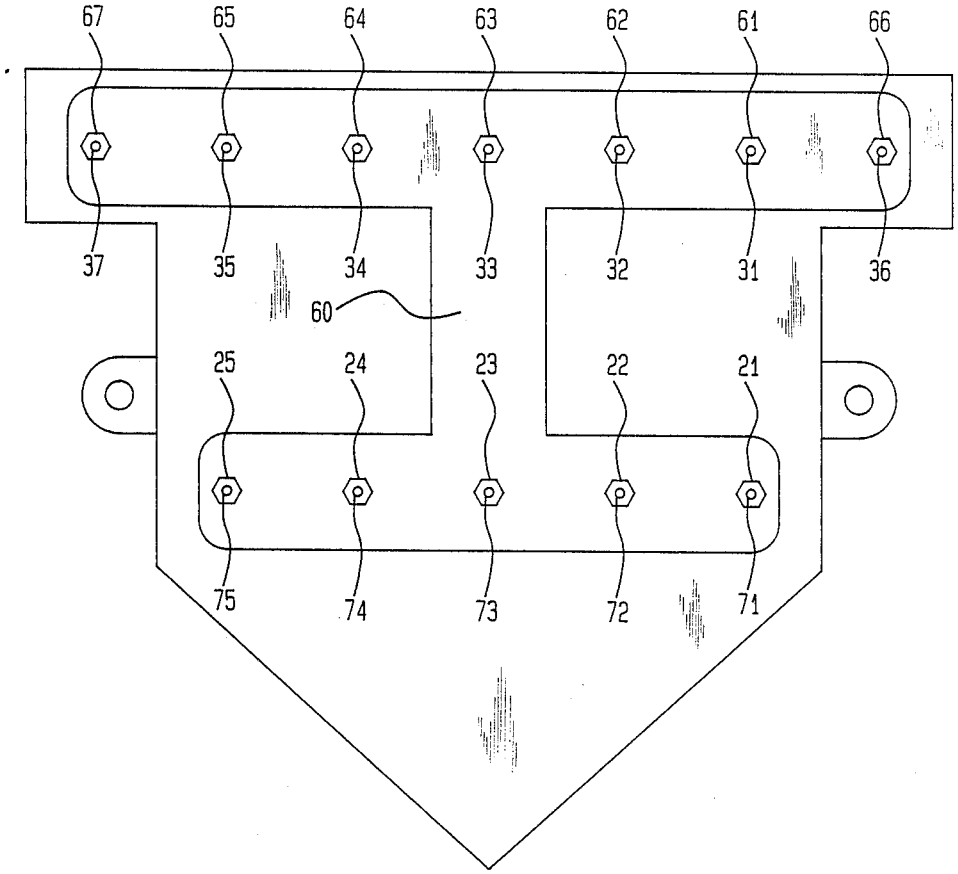
FIG. 3 is a bottom view of the base plate and extender members shown in FIG. 1.

A bottom view of combined base plate 20 and extender 30 configured as H-shaped member 60 is shown in FIG. 3. Apertures 21–25 (31–37) have countersunk hexagonal openings 71–75 (61–67) larger than the diameter of their corresponding apertures. Apertures 21–25 with their corresponding hexagonal openings 71–75 are referred to generically, as a group, as base plate mounting means and, individually, as attaching means; similarly, apertures 31–37 and hexagonal openings 61–67 are referred to as extender mounting means as a grouping or attaching means when discussed individually.

A hexagonal opening is countersunk in each aperture so that whenever a bolt 43 (FIG. 4) with a hexagonal head is inserted into the corresponding aperture, threaded end first, the head ultimately seats in the countersunk opening rendering the bolt head flush with the bottom. The threaded end is used to attach stanchions 40 or 50, as explained shortly.

Figure 4:
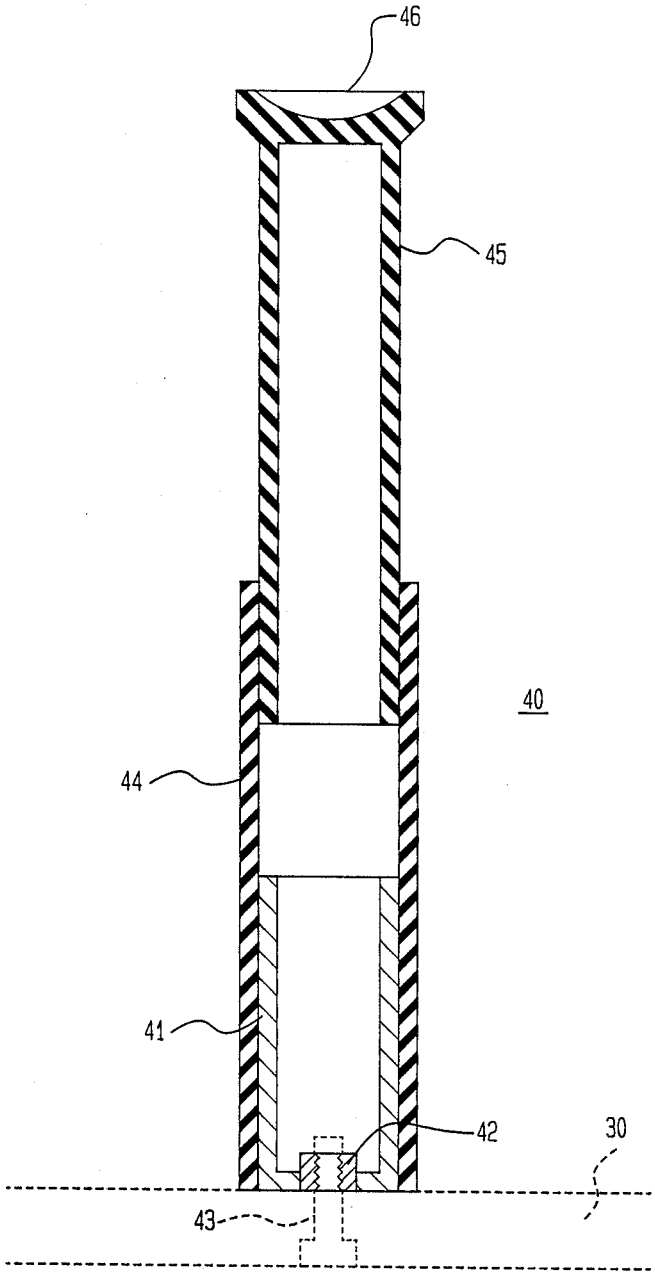
FIG. 4 is a cut-away view of adjustable pole 40 having a baseball support at its top end and taken along lines 4—4 shown in FIG. 1.

With reference to FIG. 4, a cross-sectional view of stanchion 40 shows it comprising three primary members 41, 44 and 45. Hollow cylinder 41, preferably steel, has nut 42 formed integrally in its base. This serves to anchor cylinder 41 to extender 30 via bolt 43 inserted into one of apertures 31-37 from the bottom of extender 30. Alternatively, nut 42 may be welded, soldered or otherwise permanently affixed to a cutout in the base of cylinder 41. In fact, an appropriately threaded hole positioned in the base of cylinder 41 can be substituted for the nut. Sleeve 44, preferably of rubber, is slipped over cylinder 41 with a snug fit so that its base rests on extender 30 and its free end extends beyond the top of cylinder 41. Illustratively, if cylinder 41 is about 10 inches (3.94 cm) high, sleeve 44 is about 18 inches (7.09 cm) long. Another sleeve 45, approximately 20 inches (7.87 cm) long and of rubber, is inserted into the hollow, free end of sleeve 44. The thickness and cross-sectional dimension of sleeve 44 relative to sleeve 45 are selected so that the height of pole 40 may be adjusted and then frictionally maintained by sliding and positioning sleeve 45 in the free end of sleeve 44. Formed as an integral part of sleeve 45 at its top end is baseball support 46, preferably having a cup shape as shown by dashed lines. Cylinder 41 provides stability and strength to the overall structure of pole 40. Sleeves 44 and 45 are designed with rubber that is strong enough to retain its shape yet durable and flexible enough to withstand numerous blows, either direct or glancing, from a batter. Typically, the sleeves are approximately ⅜ inches (1.48 mm) thick and cylinder 41 has an outer diameter of 1¾ inches (6.89 mm).

Stanchion 50 is essentially the same as stanchion 40 except that stanchion 50 does not have support 46. Alternatively, for purposes of redundancy and to reduce manufacturing cost, stanchions 40 and 50 may both incorporate separate supports 46 and be substantially identical to each other. When mounting stanchions 40 and 50, they are usually mounted one behind the other; for example, if they are mounted at the heart of the plate, then apertures 33 and 23 seat corresponding stanchion members, as shown in FIG. 1. To teach the contact hitter's swing, stanchion 50 has a height adjustment at least as high as stanchion 40. If the batter touches stanchion 50 during his swinging motion, then this is an indication that the swing does not have the desired orientation.

Although the illustrative embodiment utilized frictional contact between sleeves 44 and 45 to position and maintain the height adjustment, it is possible for one skilled in the art to contemplate other equivalent arrangements. For instance, a spring-loaded pin could be inserted into periodically formed and aligned holes cut horizontally through each of sleeves 44 and 45. Also, it would be possible to utilize threaded apertures 21–25 in base plate 20 and, correspondingly, cylinder 41 could be formed with a bolt in place of the nut.

With reference to FIG. 5, the second operational mode of device 40 is depicted, namely, as a pitching practice aid. As shown, poles 40 and 50 are now both mounted to extender 30 in the two outermost apertures 37 and 36, respectively. These two apertures are formed in extender 30 so that, when poles 40 and 50 are affixed to the mounting means, the distance shown as S between the respective outer surfaces of the poles is substantially the same as width F of home plate. Also now shown on pole 40 are narrow, circumferential markings 47, on sleeve 45, and markings 48 on sleeve 44. These markings are typically bright in color, such as yellow or orange. By adjusting sleeve 45 up or down, a height shown as H in FIG. 5 may be selected as representative of the high-low strike zone of an imaginary batter. The broken, periodic placement of the markings allows the pitcher to judge not only whether the pitch is a ball or strike, but just where the pitch entered the ball or strike zone. Pole 50 has similar markings 57 and 58 complementary to markings 47 and 48, respectively. Alternatively, one or more suitable markings, such as illustratively colored tabs, dowels or the like, can also be inserted into the surface of each pole after that pole has been raised to a desired height. In this case, the top of the poles would define the top of the strike zone; while the marking(s) may define the bottom and/or an intermediate point in the zone.

It is to be understood that the baseball practice device illustrated herein is not limited to specific forms by way of example and illustration, but may assume other embodiments limited only by the scope of the appended claims.

I claim:

1. A baseball batting practice device comprising:

a planar base plate representative of home plate;

a base plate extender abutting the frontal edge of said base;

said extender including a plurality of first mounting means arranged substantially parallel to said frontal edge and said base plate including a plurality of second mounting means arranged substantially parallel to said first mounting means along an intermediate transversal portion of said base;

first adjustable pole means adapted for vertical mounting on at least one of said first mounting means, said first pole means having a baseball support at its top; and second adjustable pole means adapted for vertical mounting on at least one of said second mounting means; wherein said first and second pole means are cooperatively positioned on their respective mounting means and adjusted in height so that a batter connects with the baseball in said support, over said extender and in front of said base, with a swinging motion determined by the combined positions and adjustments of both said pole means.

2. The device as recited in claim 1 wherein said base plate is pentagonally shaped and said extender is rectangularly shaped with its longer dimension adjacent said frontal edge so that said first mounting means is proximate to said frontal edge.

3. The device as recited in claim 1 wherein said first pole means and second pole means are respectively mounted to a selected one of said mounting means so that said second pole means is directly behind said first pole means and the height of said second pole means is at least as high as said first pole means to effect a downward swinging motion.

4. The device as recited in claim 1 wherein said base plate and said extender are formed from a unitary piece-part.

5. The device as recited in claim 4 wherein said unitary piecepart includes an H-shaped metal workpiece covered with a rubber-like material to provide said base plate with a pentagonal shape corresponding to the shape of home plate.

6. The device as recited in claim 1 wherein each of said mounting means includes an aperture extending through said base plate and said extender, respectively, each of said apertures having an enlarged, countersunk portion on the underside of said base plate or said extender, respectively, each one of said plurality of mounting means further including a bolt for inserting into a corresponding one of said apertures, said bolt having a head for seating in said countersunk portion and a threaded end protruding above the top of said base plate or said extender, respectively, to register the associated one of said pole means.

7. The device as claimed in claim 6 wherein each of said pole means further comprises:

a cylinder metal housing having a nut integral to its base end for attaching to said bolt;

a first rubber sleeve slip mounted over said metal housing; and a second rubber sleeve inserted into said first rubber sleeve in telescopic fashion; wherein said first sleeve and second sleeve are cooperatively engaged and arranged for frictional adjustment by sliding said second sleeve relative to said first sleeve.

8. The device as recited in claim 7 wherein said support is a cup formed integrally with said second sleeve at its top end.

9. A baseball pitching device comprising:

a planar base plate representative of home plate;

an extender positioned along the frontal edge of said base, said extender including left and right mounting means straddling left and right base plate edges transverse to said frontal edge;

adjustable left pole means vertically mounted in said left mounting means, said left pole means having at least one height marking along its vertical extent; and adjustable right pole means vertically mounted in said right mounting means, said right pole means having at least one height marking along its vertical extent; wherein said left and right pole means are cooperatively adjusted in height so that a pitched baseball is a strike when it is thrown between said pole means and within a strike zone range as determined by said markings on said adjusted pole means.

10. A baseball practice device comprising:

a planar base plate representative of home plate;

an extender positioned along the frontal edge of said base;

said extender including a plurality of first mounting means arranged substantially parallel to said frontal edge and said base plate including a plurality of second mounting means arranged substantially parallel to said first mounting means along an intermediate portion of said base;

first adjustable pole means adapted for vertical mounting in one of said first and second mounting means, said first pole means having a baseball support at its top and at least one height marking along its vertical extent; and second adjustable pole means adapted for vertical mounting in one of said first and second mounting means, said second pole means having at least one height marking along its vertical extent, wherein the device has a first operational mode as a batting tee such that:

said first pole means is vertically mounted in one of said first mounting means;

said second pole means is vertically mounted in one of said second mounting means; and said first and second pole means are cooperatively positioned in their respective mounting means and adjusted in height so that a batter contacts the baseball in said support in front of said base plate and with a swinging motion determined by the combined positions and adjustments of both said pole means; and wherein the device has a second operational mode as a strike zone indicator such that both said first and second pole means are mounted in said extender in respective mounting means straddling the left and right edges of said base plate transverse to said frontal edge, both said pole means cooperatively adjusted in height so that a pitched baseball is a strike when it is thrown between said pole means and within a strike zone range as determined by said markings on said adjusted pole means.

11. The device as recited in claim 9 wherein said base plate is pentagonally shaped and said extender is rectangularly shaped with its longer dimension adjacent said frontal edge so that said first mounting means is proximate to said frontal edge.

12. The device as recited in claim 10 wherein said first pole means and second pole means are respectively mounted to a selected one of said attaching mounting means so that second pole means is directly behind said first pole means and the height of said second pole means is at least as high as said first pole means to effect a downward swinging motion in said first operational mode.

13. The device as recited in claim 10 wherein said base plate and said extender are formed from a unitary piecepart.

14. The device as recited in claim 13 wherein said unitary piecepart includes an H-shaped metal workpiece covered with a rubber-like material to provide said base plate with a pentagonal shape corresponding to the shape of home plate.

15. The device as recited in claim 10 wherein each of said mounting means includes an aperture extending through said base plate and said extender, respectively, each of said apertures having an enlarged, countersunk portion on the underside of said base plate or said extender, respectively, each of said mounting means further including a bolt for inserting into a corresponding one of said apertures, said bolt having a head for seating in said countersunk portion and a threaded end protruding above the top of said base plate or said extender, respectively, to register the associated one of said pole means.

16. The device as recited in claim 15 wherein each of said pole means further comprises:

a cylindrical metal housing having a nut integral to its base end for attaching to said bolt;

a first rubber sleeve slip mounted over said metal housing and having color lines for said markings; and a second rubber sleeve inserted into said first rubber sleeve in telescopic fashion and having color lines for said markings, wherein said first sleeve and second sleeve are cooperatively engaged and arranged for frictional adjustment by sliding said second sleeve relative to said first sleeve.

17. The device as recited in claim 16 wherein said support is a cup formed integrally with said second sleeve at its top end.

18. The device as recited in claim 16 wherein said first and second sleeves are adjusted relative to each other to provide said high-low range with said color markings in said second operational mode.

* * * * *